US006142560A

United States Patent [19]

Miller

[11] Patent Number: 6,142,560

[45] Date of Patent: Nov. 7, 2000

[54] COLLAPSIBLE CHILD'S TABLE

[76] Inventor: Steve J. Miller, 97 W. 300 South, Millville, Utah 84326

[21] Appl. No.: 09/326,331

[22] Filed: Jun. 7, 1999

[51] Int. Cl.[7] ..... A47B 3/14

[52] U.S. Cl. ..... 297/158.4; 297/158.5

[58] Field of Search ..... 297/158.3, 158.4, 297/158.5, 159.1

[56] References Cited

U.S. PATENT DOCUMENTS

| | | | |
|---|---|---|---|
| 2,583,247 | 1/1952 | Aja et al. . | |
| 2,690,210 | 9/1954 | Holick . | |
| 2,748,837 | 6/1956 | Beller . | |
| 3,135,552 | 6/1964 | Lockshin | 297/452.63 |
| 4,040,658 | 8/1977 | Mayol . | |
| 4,060,275 | 11/1977 | Hansen | 297/158.4 |
| 4,572,574 | 2/1986 | Fischhaber et al. . | |
| 4,648,652 | 3/1987 | Van Kuren | 297/158.4 |
| 5,240,307 | 8/1993 | Jones et al. | 297/158.5 |
| 5,411,314 | 5/1995 | Wallace . | |

*Primary Examiner*—Peter R. Brown

*Attorney, Agent, or Firm*—M. Reid Russell

[57] ABSTRACT

A collapsible child's table that include components preferably formed from a plastic material utilizing molding methods to include a flat table top having integral first hinge sections that are spaced apart and extend downwardly from the table top undersurface and are adjacent to the table top corners that are to receive and interdigitate with second hinge sections that are formed as ends of individual legs of two pairs or legs, with said interdigitated hinge sections to receive pins fitted therethrough as pivot couplings of the pairs of legs to the table top. Further, each of the legs of the pairs of legs, include a bent top end and the pairs of legs each include a cross brace formed thereacross, having straight ends extending outwardly from the opposite leg sides. A bench assembly is provided to fit around the table top and includes a pair of spaced parallel straight benches with like straight sides extending between the bench ends, forming a rectangle, and with each bench end including a cap wherefrom a tab coupling extends from a lower cap surface to slide over an end of each of the pair of legs cross braces for connecting the bench assembly to the pairs of legs to erect the table.

14 Claims, 5 Drawing Sheets

COLLAPSIBLE CHILD'S TABLE

BACKGROUND OF THE INVENTION

1. Field of the Invention

The present invention relates to folding furniture and in particular to a table that can be folded upon itself, reducing the table height, for convenience in transport and storage.

2. Prior Art

Furniture items have long been constructed to be capable of being folded or collapsed upon themselves for storage and transport and are easily erected for use. Tables are no exception and a number have been constructed with pivoting members to be easily erected, with an example of such collapsible item being a card table, where the four legs are each pivot mounted to a table corner to be lowered and locked into place, erecting the table. Similarly, a number of tables have been manufactured to included pivotally mounted pairs of legs arranged at opposite ends of a flat table top to be pivoted apart into an erected attitude and including center braces that are folded out, or otherwise erected, to extend between a table undersurface and a lower portion of each of the pairs of legs. Like such earlier arrangements, the collapsible table of the invention includes two pairs of legs that are pivotally mounted to opposite ends of the under-surfaces of a table top, each pair to pivot outwardly to a right angle to that table top during erection. Unlike such earlier collapsible tables, however, the invention does not require center support struts, or the like.

The table of the invention is a table with a bench seat combination, commonly known as a picnic table. It is preferably small in size, is manufactured from durable light weight material, such as a plastic by molding methods, and is suitable for use by a child. The table, in addition to folding end legs, includes a combination bench assembly with side rail assembly that is to fit to the erected legs by sliding tabs formed in the side rails, behind the ends of side sections that extend across and project from the individual legs of each pair of legs. The table of the invention does not require an installation of separate connections for the table to be maintained in an erected attitude. Whereas, collapsing of the table requires only a lifting of the bench assembly side rail tabs off from the ends of the pair of leg sides and moving the bench assembly upwardly to the plane of the table. Thereafter, the pairs of legs are folded upwardly into engagement with the table top bottom surface. The table thereby presents a minimum height dimension and is convenient for storage and transport.

Like the invention, a number of earlier tables have provided pairs of legs where each pair is pivotally mounted to an opposite table top end and including benches, and examples of such earlier arrangements are shown in to Holick, U.S. Pat. No. 2,690,210; to Beller, U.S. Pat. No. 2,748,837; to Mayol, U.S. Pat. No. 4,040,658; to Hansen, U.S. Pat. No. 4,060,275; to Van Kuren, U.S. Pat. No. 4,648,652; to Jones, et al., U.S. Pat. No. 5,240,307; and to Wallace, U.S. Pat. No. 5,411,314. None of these U.S. Patents, however, include an easily releasable coupling tab arrangement like the invention for maintaining and supporting the bench assembly, at its side supports, to a crossing side of each of the pair of legs, maintaining the erected legs without a requirement for leg braces as are required by each of the cited patents.

Like the invention, to Aja, et al, U.S. Pat. No. 2,583,247, and Fischhaber, et al., U.S. Pat. No. 4,572,574, show tables that each include a combination of table top whereto is pivot mounted pairs of table legs that are maintained by separate connectors to bench assembly side rails. The connection arrangements of both these patents, however, involve separate fasteners that are individually fitted or connected through the bench assembly side rails and into or through the pairs of legs to maintain the table in an erected state. Distinct therefrom, the invention provides a mounting of the bench assembly side rails to the pairs of legs without a use of separate connectors. The connection of which table sections of the invention requires only a lowering of the bench assembly from its stowed or recessed attitude, where it aligns with the table top, to moving tabs of the bench assembly side rails over ends of each of the pair of legs cross braces, completing the table erection. Further, unlike earlier collaspsible table arrangements, breakdown or collapse of the table of the invention involves only a lifting of the bench assembly away from the pairs of legs cross braces, pulling the tabs off from the cross braces ends and lifting of the bench assembly to its stowed position alongside the table top. Whereafter the pairs of legs are pivoted into engagement with the table top undersurface.

SUMMARY OF THE INVENTION

It is a principal object of the present invention in a collapsible child's table to provide a light weight table arranged to be easily erected and maintained without an installation of separate connections and which table can be quickly broken down to present a minium height dimension for transport or storage.

Another object of the present invention in a collapsible child's table is to provide a table that, in a collapsed state, has a very narrow height dimension for ease of transport and storage, is easily erected, and does not require an installation of separate connectors or fasteners, or the like, to maintain the table in an erected attitude.

Still another object of the present invention in a collapsible child's table is to provide a table that can be erected from a collapsed state with a first outward pivoting of each pair of table legs to a right angle to the table top, and by a sliding bench assembly along the table legs to fit tabs in the bench assembly over ends of each of the sides of the pairs of legs, completing the assembly.

Still another object of the present invention in a collapsible child's table is to provide a table where the table components are preferably formed from a plastic material by molding methods to be light in weight and where the component will easily fit together and be collapsible to have a minimum height dimension, with the table, when erected, to provide a strong stable structure.

The present invention is in a collapsible child's table that is preferably formed from a plastic material by molding methods as table sections that include: a table top; pairs of legs for pivotal mounting at their top ends to extend from opposite table undersurface ends, and including a bench assembly that is arranged as a rectangle with its ends to slide over the erected leg pairs and couple thereto. The bench assembly is connected to erected leg pairs by passing tabs that are formed in to extend from the bench assembly sides over cuts formed in a cross brace of each of the pair or legs. The legs are thereby maintained to the bench assembly sides providing a rigid and secure erected table. Release of the bench assembly from the pairs of legs requires only a lifting of the bench assembly tabs out of engagement with each of the pair of leg braces and a further lifting to position the bench assembly along side and on line with the table top. Whereafter, the pairs of legs are each pivoted inwardly towards and into engagement with the table undersurface.

When collapsed, the table presents a minimum height dimension for convenient transport and storage.

BRIEF DESCRIPTION OF THE DRAWINGS

These and other objects and features of the present invention will become more apparent from the following description in which the invention is described in detail in conjunction with the accompanying drawings.

DETAILED DESCRIPTION

FIGS. 1 through 5 show what is currently believed to be a best mode for practicing the invention in a collapsible child's table 10, hereinafter referred to as table 10. The table 10 legs, top and benches are preferably formed from a plastic material, such as a polyvinyl chloride with table and bench end caps 15 and 23, respectively, when formed separately, preferably formed from a calcium carbonate polypropylene, or the like. The table components or elements are preferably formed by molding methods. Though, of course, it should be understood the invention as shown and as described can be constructed of another material utilizing other methods within the scope of this disclosure.

Figure 1:
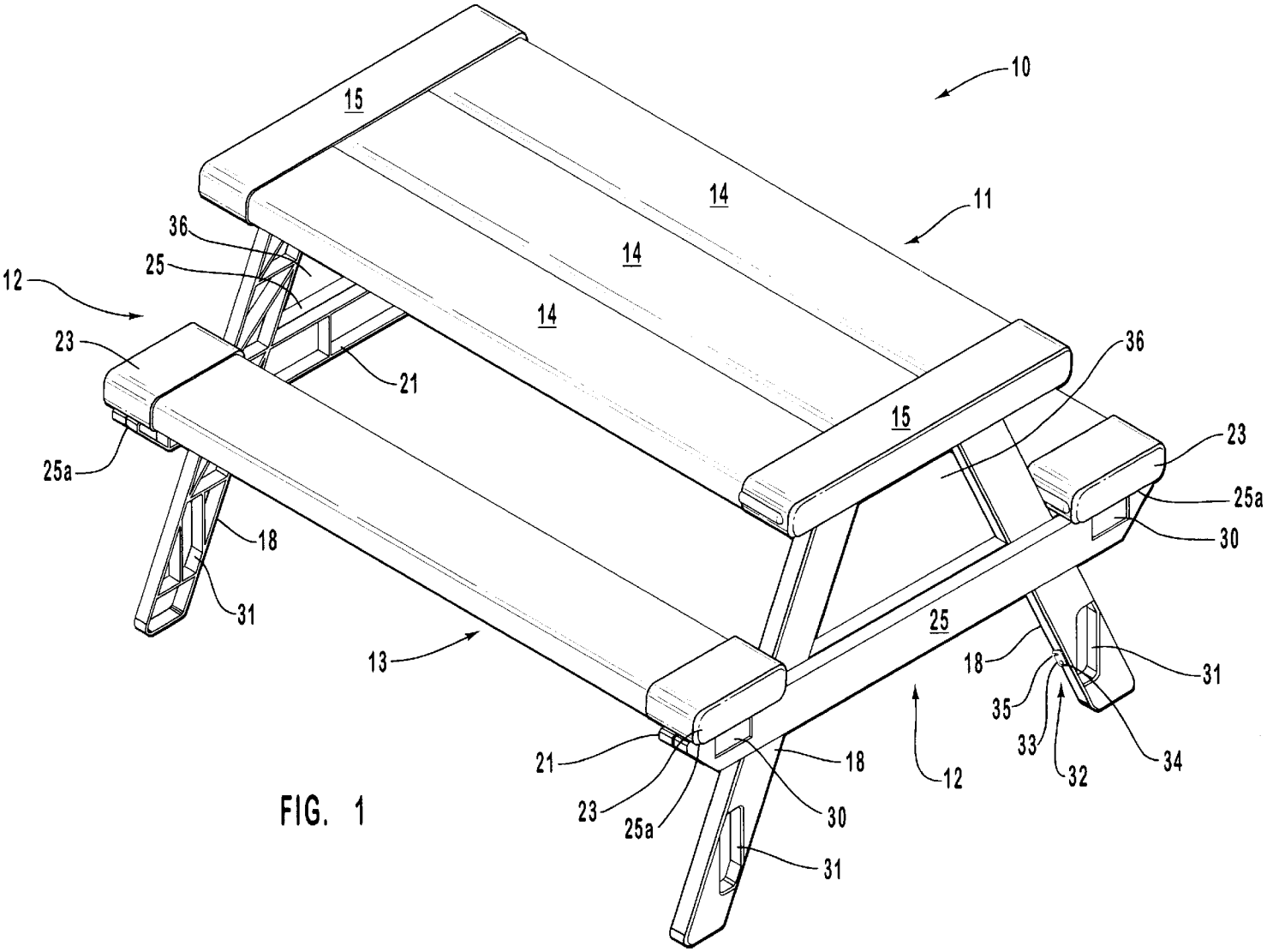
FIG. 1 is a side and top elevation perspective view taken from the side of an erected collapsible child's table of the invention.

The table 10, as shown in FIG. 1 in an erected attitude to include a top 11, shown as a flat arrangement of side by side planks 14, having an undersurface 11*a*, wherefrom are pivotally attached pairs of table legs 12, at the table top ends, respectively, and includes a bench assembly 13 that is shown as a rectangle that is open to fit over and travel up and down the extended pairs of legs, with bench assembly sides 25 to engage ends of a pair of legs cross braces 20 to erect the table. The table top 11 is shown in the Figures. as including the parallel planks 14 that are joined along common edges into a rigid flat table top and include end caps 15 that are fitted thereto across the plank ends. The end caps 15, as shown best in FIGS. 3 through 5, fit as caps over the ends of planks 14 and can be formed as part therafter in the molding process or are secured thereto as by bonding as with an adhesive heat welding, or the like. Spaced pairs of hinge sections 16 are secured to the end caps 15, extending from each cap 15 lower surface. Preferably, the hinge surfaces 16 are each halves of pin receiving hinges and are arranged to interdigitate with leg hinge sections 17 formed as top or upper ends of individual legs 18 of each or the pair of table legs 1. The hinge sections 16 and 17 to receive pins 19 fitted therethrough, forming a pivot mount for each leg 18 of the pairs of table legs 12, allowing the pairs of legs 12 to pivot away from to erect the table 11 undersurface 11*a*.

Figure 2:
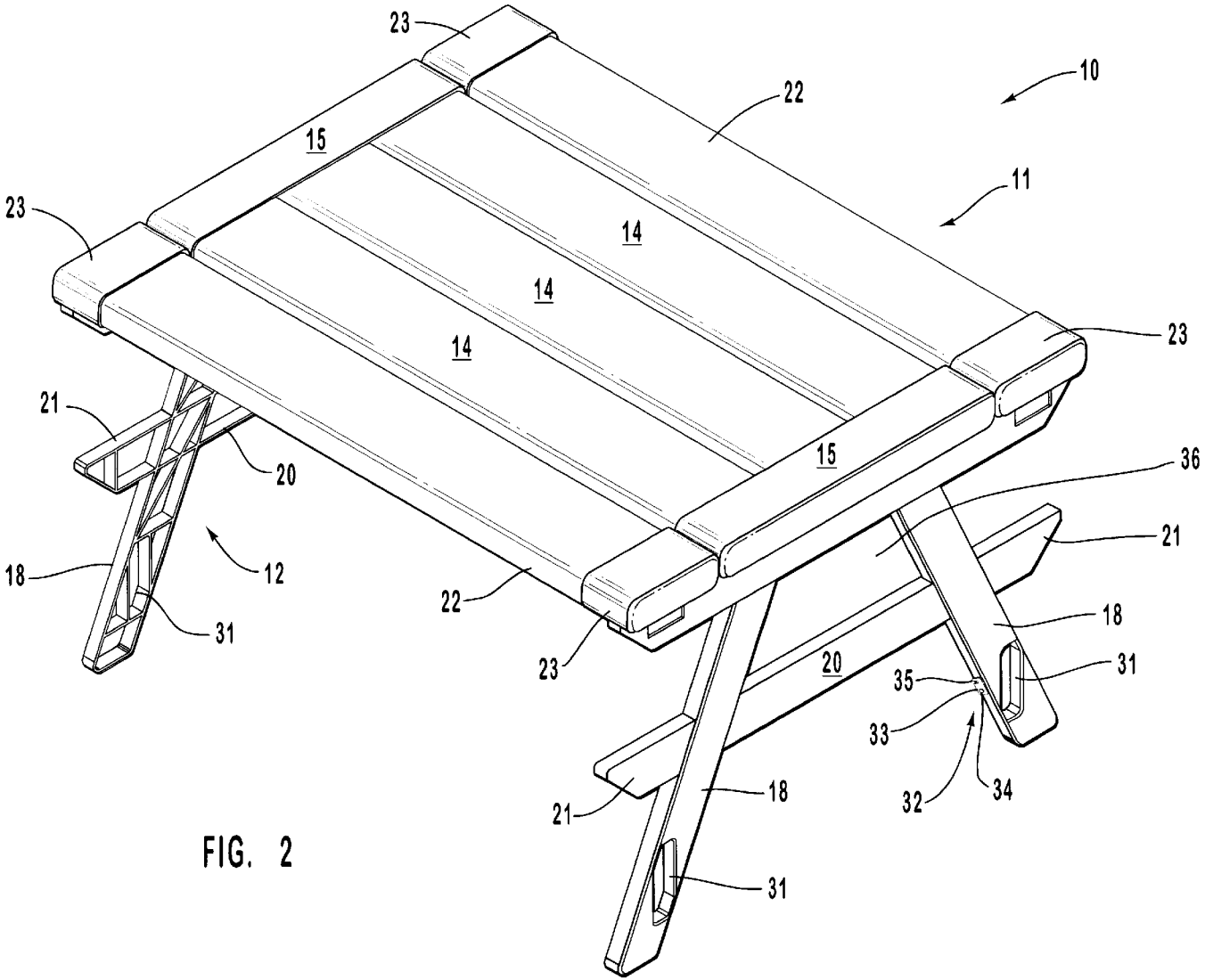
FIG. 2 is a view like that of FIG. 1 only showing a table bench assembly as having been disengaged from each of a pair of table legs and elevated to a position alongside and in alignment with the opposite table top long sides.
Figure 3:
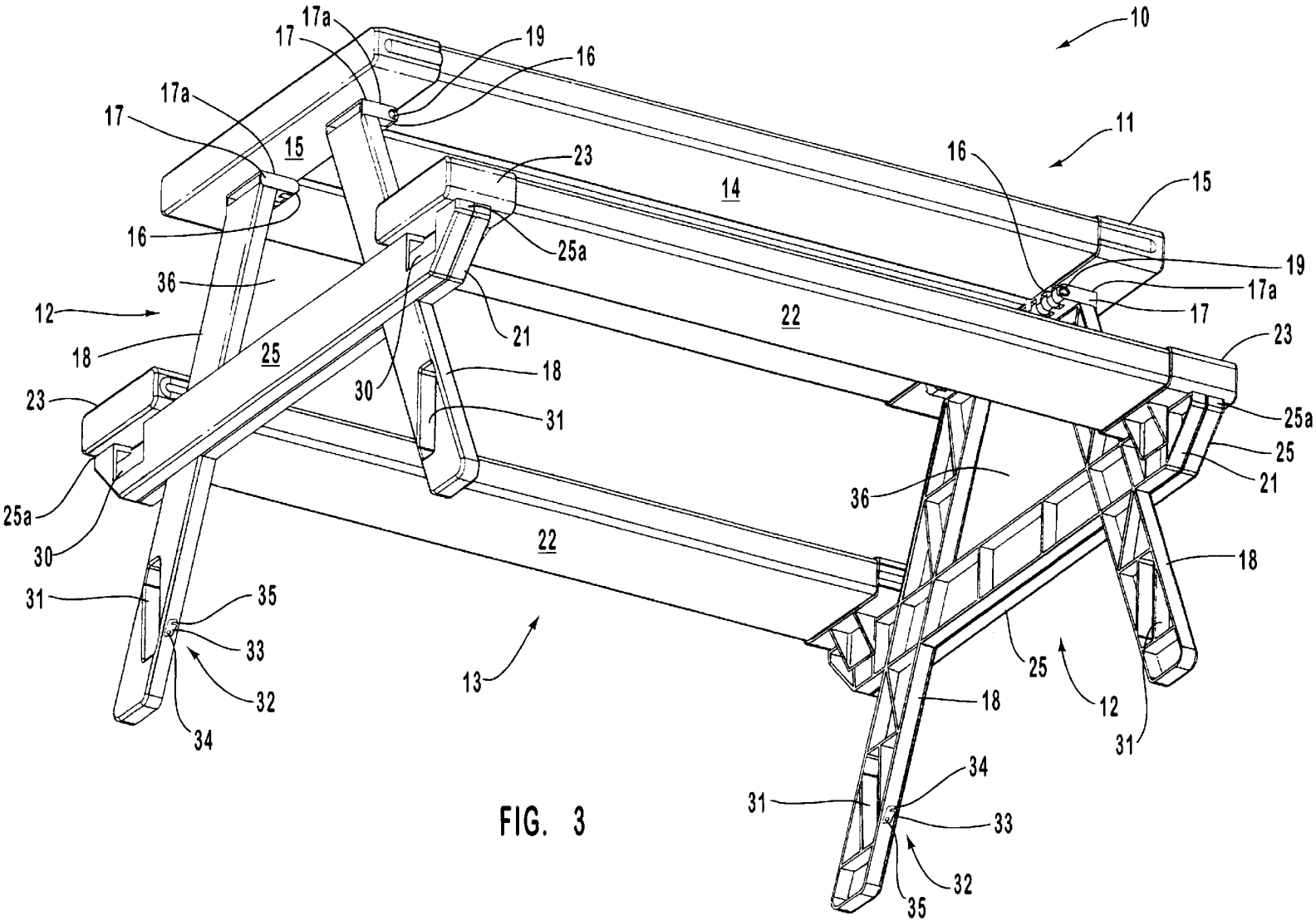
FIG. 3 is a bottom plan perspective view of the table of FIG. 1, taken from one side thereof.
Figure 4:
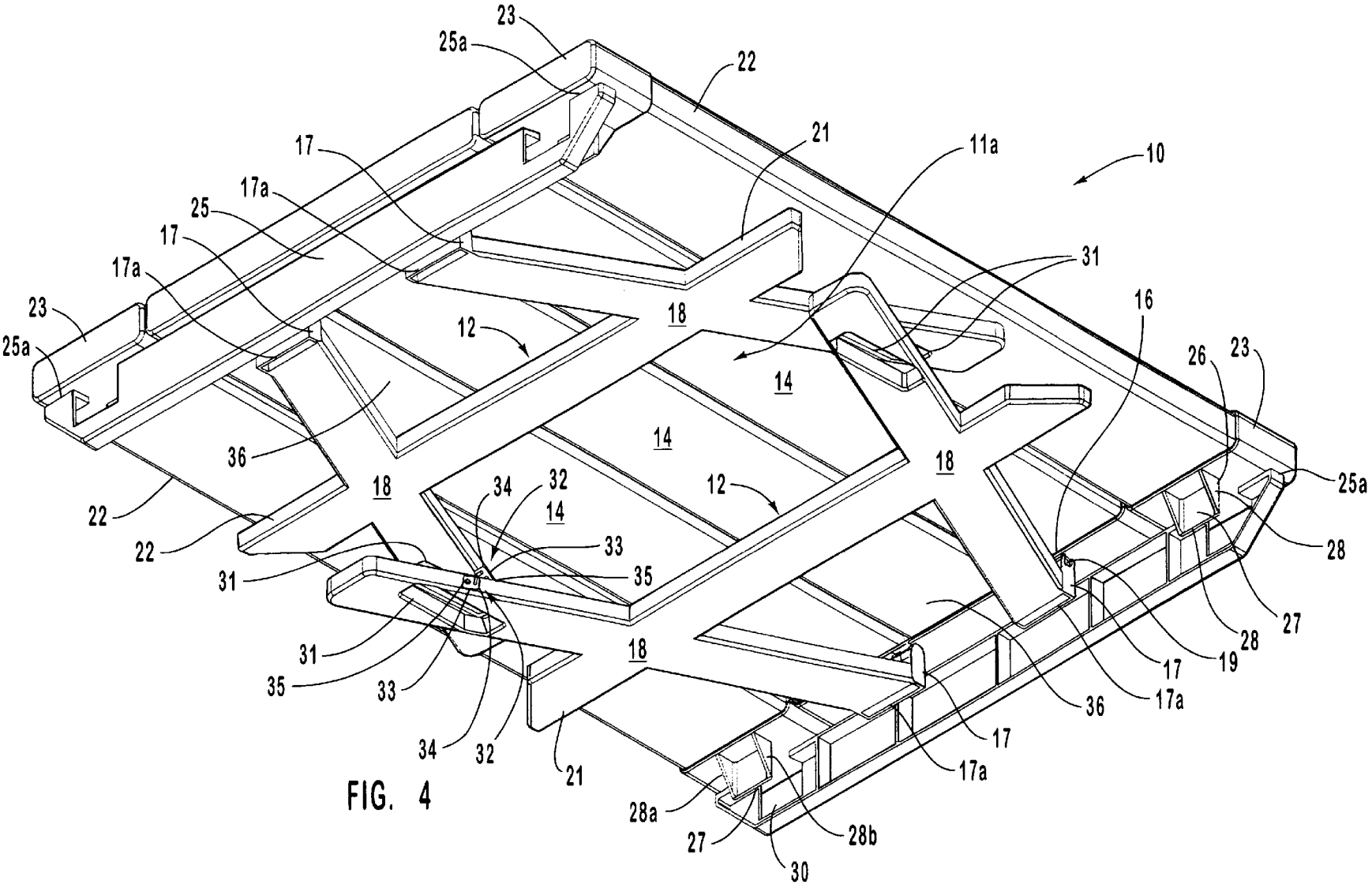
FIG. 4 is a collapsed bottom plan perspective view of the table of FIG. 1.
Figure 5:
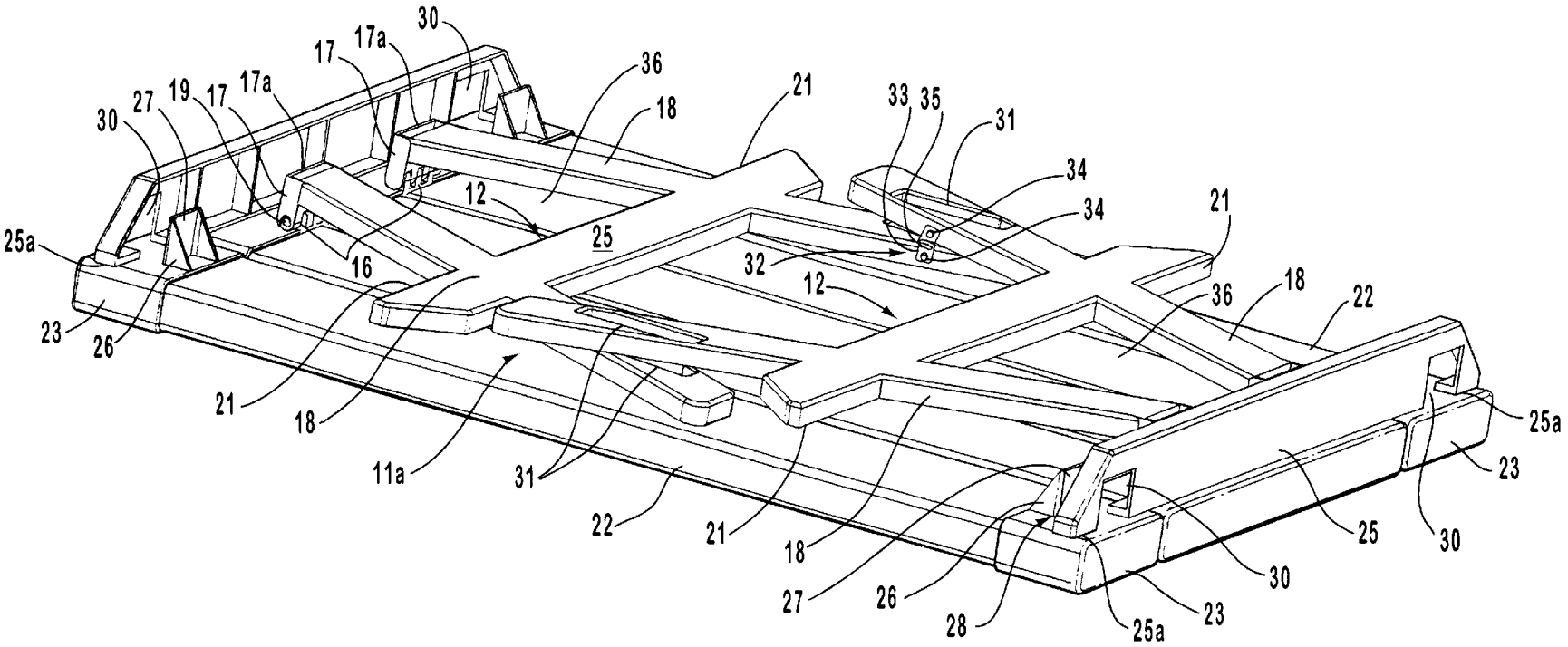
FIG. 5 is a side elevation perspective view of the collapsed table of FIG. 4 that has been rotated to where the table top rests on a surface.

The leg hinge sections 17, as shown, are formed as ends of bent sections that are formed at the leg top ends, the angles of each bent section to angles equal one another and are less than ninety (90) degrees. So arranged, a flat surface 17*a* is provided as each leg 18 upper end, as shown in FIGS. 3 through 5, that is to engage that table 11 undersurface 11*a* when the pairs of table legs 12 are pivoted from a stowed attitude, as shown in FIGS. 4 and 5, to an erected attitude, as shown in FIGS. 1 through 3. Each flat surface 17*a* provides a support surface that engages the table top undersurface to transfer weight placed on the table top therethrough and into the individual legs 18. With the junction of the leg hinge sections 17 to the legs 18 at less than a ninety (90) degree angle, the pairs of table legs 12 slant oppositely outwardly from the table top 11 undersurface 11*a*, discouraging the table from buckling should a side load be directed thereagainst.

Each of the pairs of table legs 12 is formed as a single unit to include a cross brace 20 that has opposite ends 21. With the pairs of legs 17, as shown, like the table top, also preferably formed from a plastic material such as polyvinyl chloride, by molding methods. The cross braces 20 link the individual legs 18, to provide a structure to resist individual twisting and, as set out below, with an outerface of each cross brace to engage an interface of a straight side 25 of the bench assembly 13 stabilizing the erected table 10. Further, each cross brace 20 includes ends that cooperate with leg lock tabs 26 as bench assembly coupling ends, with the leg lock tabs 26 to receive the bench assembly 13 sides 25, for locking the table 10 in an erected attitude, as set out and described below.

Additional to the sides 25, the bench assembly 13, includes a pair of bench seats 22 having the ends of the sides 25 that are secured at right angles to the seat 22 ends that receive caps 23, that, along with caps 15, as preferably formed from a calcium carbonate polypropylene plastic, as shown, the bench assembly 13 is formed as an open rectangle. The seats are preferably a laminate of sections of flat planks of polyvinyl chloride plastic joined together to form a rigid bench whose with ends thereof are preferably capped by caps 23 that may be formed therewith in the molding process or separately formed, as set out above, and attached thereto with an adhesive. Ends 25*a* of the sides 25 are secured to extend at right angles downwardly from the bottom of the end of the pair of caps 23, and, adjacent thereto, leg lock tabs 26 are formed to be offset outwardly at right angles from bases, the tab faces parallel to the sides 25 to receive the ends 21 of cross braces 20 that are fitted therein during erection of table 10, as shown in FIGS. 1 and 3.

Shown in FIGS. 4 and 5, the leg lock tabs 26 are aligned with openings or cuts 30 made into the assembly sides 25 that are provided for viewing fitting of cross brace ends 21 during table 10 erection. The leg lock tabs 26 are identical and each is preferably formed in the molding process formed extensions of the caps 23 to align with the opening or cut 30 in sides 25 and extend at a ninety degree or right angle downwardly from the cap 23 under surface. Each leg lock tab 26, as shown, includes a flat plate 27 secured along an edge to the cap 23 under surface, to be parallel to the face of cross brace 21 and each incorporates side or gusset plates 28, shown as triangular sections, that are secured to the plate opposite sides along one plate triangle leg or side with the other triangle leg or side secured to the cap 23 undersurface. Each leg lock tab 26 is to receive an end 21 of the cross brace 20 that is slid therein when the bench assembly 13 is lowered from the attitude shown in FIG. 2 to the attitude shown in FIGS. 1 and 3. So arranged, each leg lock tab 26 flat plate 27 passes over a cross brace end 21. In that coupling, the cross brace 21 outer surface is urged against and held in contact with the inner surface of a bench assembly side 25.

So arranged, the individual legs 18 of each of the pair of legs 12 are supported at both their pivot mountings to the table top 11 undersurface 11*a*, at the mounting of the leg cross brace ends 21 fitted into leg lock tabs 26, and by contact between the bench assembly sides 25 and cross braces 20, thereby providing a strong and sturdy erected table.

In practice, as shown in the drawings, the different components or members of the table 10 are preferably formed from a plastic material, as set out above, by molding methods, with each component to have an outer flat surface with structural ribs and braces formed across undersurfaces thereof So arranged, the components are light in weight and strong. Further, for ease of handling, slots 31 are preferably formed in each of the legs 18 that, with the table collapsed as shown in FIGS. 4 and 5, align and are to function as handles to accommodate receiving an operators hand, not shown, for lifting and carrying the table 10. Additionally, at least one latch 32, as shown in the Figures, is provided that is preferably a flat section of a metal 33, and is attached by a pin 34 to a side of a first leg 18, with the flat section including a slot 35 formed therein that is to fit into and slide within a like slot 35 of a like latch 32 that is mounted to a second of the legs 18, as shown in FIGS. 4 and 5, for holding the pairs of legs 12 together when the table is collapsed. Alternatively, the latch slot 35 may be passed over a pin, or the like, not shown, that is fitted into to extend outwardly from the second table leg 18, for maintaining the legs 18 together with the table 10 in a collapsed state.

Additionally, the table 10 includes an open area 36 between the legs 18 and above the cross brace 20 that may receive or include a plate, not shown, fitted or formed therein to function as a reinforcing plate and may also include the table name, or the like, embossed thereon, as required.

It should be understood that, while a best mode for practicing the invention has been shown and described herein as a preferred embodiment of a collapsible child's table, the present disclosure is made by way of example only and variations and changes thereto are possible without departing from the invention subject matter, and a reasonable equivalency thereof, that come within the scope of the following claims, which claims I regard as my invention.

I claim:

1. A collapsible child's table comprising, a flat rectangular table top that includes spaced first hinge sections that each extend from a table top undersurface, proximate to corners thereof; two pairs of legs with each leg of each said pair having a second hinge section formed at an upper end thereof and each said pair includes a straight cross brace that extends between the legs of each said pair, with each said cross brace having ends that extend beyond each said leg; pin means for fitting through said first and second hinge sections; a bench assembly formed as a wide rectangle that is open across its center and includes a pair of straight aligned identical benches that are parallel to one another and have straight side members secured to said benches aligned ends, forming the wide rectangle and including, proximate to the junction of each said bench end and one of said side member ends, a tab means secured to each said bench end that includes a flat plate that is secured to extend at approximately a right angle from said bench end undersurface and, where, with each said pair of legs pivoted to extend from said table top under surface, each said tab means flat plate fits to slide over an end of one of said pair of legs cross braces, thereby releasably locking, without fasteners, said bench assembly side members to said pairs of legs cross braces.

2. The collapsible child's table as recited in claim 1, wherein the table top is formed from planks maintained in side by side relationship forming a flat surface and further including end caps secured over the plank ends.

3. The collapsible child's table as recited in claim 2, wherein a pair of the first hinge sections are secured, in spaced apart relationship, to extend from the undersurface of each table top end cap.

4. The collapsible child's table as recited in claim 1, wherein the second hinge sections are formed as ends of bent sections formed in the table leg ends that are bent at less than ninety degree angles to each leg top end and includes a flat face that, with the pairs of legs pivoted to extend outwardly from the table top undersurface, will engage said table top undersurface.

5. The collapsible child's table as recited in claim 1, wherein each tab means includes a flat rectangular plate secured along one side to a bench end cap undersurface to extend at a right angle therefrom and further includes a pair of triangular gusset plates with each gusset plate secured to an opposite parallel side of said rectangular plate and with the other triangle side of each said gusset plate secured to said bench end cap undersurface, with each said tab means rectangular plate faces to receive and slide over a leg cross brace end.

6. The collapsible child's table as recited in claim 5, wherein an opening is formed in the bench assembly sides opposite to each tab means for viewing fitting of a flat plate over a cross brace end during table erection.

7. The collapsible child's table as recited in claim 1, wherein the table top, pair of legs and bench assembly are formed from plastic.

8. The collapsible child's table as recited in claim 7, wherein the table top, pair of legs and bench assembly are formed from a polyvinyl chloride plastic utilizing molding methods.

9. The collapsible child's table as recited in claim 7, further including end caps formed from a plastic material to fit over the table top and bench ends.

10. The collapsible child's table as recited in claim 9, where the end caps are formed from a calcium carbonate polypropylene plastic.

11. The collapsible child's table as recited in claim 1, further including at least one first latch means arranged on at least one leg of a first of the pairs of legs to engage and couple to a second latch means secured to one leg of a second of the pairs of legs when said pairs of legs are pivoted to a stowed attitude that is adjacent to the table top undersurface.

12. The collapsible child's table as recited in claim 1, wherein the first latch mean is a flat section of metal that is mounted by a pin to a leg surface to be turned across the leg and includes a slot formed in said flat section of metal to fit and couple to the second latch means.

13. The collapsible child's table as recited in claim 12, wherein the first and second latch means are alike.

14. The collapsible child's table as recited in claim 1, further including hand engaging openings formed in one of each of the pairs of legs to receive a persons hand fitted thereto as a hand hold for carrying the table, which said hand engaging openings align when said pairs of legs are pivoted to a stowed attitude that is adjacent to the table top undersurface.

* * * * *